US009830774B1

(12) United States Patent
Rosenberg

(10) Patent No.: US 9,830,774 B1
(45) Date of Patent: Nov. 28, 2017

(54) BUSINESS METHOD

(71) Applicant: Sander Roy Rosenberg, Las Vegas, NV (US)

(72) Inventor: Sander Roy Rosenberg, Las Vegas, NV (US)

( * ) Notice: Subject to any disclaimer, the term of this patent is extended or adjusted under 35 U.S.C. 154(b) by 0 days.

(21) Appl. No.: 15/481,281

(22) Filed: Apr. 6, 2017

(51) Int. Cl.
*G07F 17/32* (2006.01)

(52) U.S. Cl.
CPC ..... *G07F 17/3244* (2013.01); *G07F 17/3293* (2013.01)

(58) Field of Classification Search
CPC ..... G07F 17/34; A63F 1/00; A63F 2001/008
See application file for complete search history.

(56) References Cited

U.S. PATENT DOCUMENTS 5,324,041 A * 6/1994 Boylan ..... A63F 3/00157 273/292
2002/0137558 A1* 9/2002 Hartl ..... A63F 3/00157 463/11
2004/0224777 A1* 11/2004 Smith ..... A63F 1/00 463/47
2005/0269781 A1* 12/2005 Sorge ..... A63F 3/00157 273/292
2009/0020951 A1* 1/2009 Colacone ..... A63F 1/00 273/292
2009/0267301 A1* 10/2009 Au-Yeung ..... A63F 1/00 273/292
2016/0335852 A1* 11/2016 Wolff ..... G07F 17/3293

OTHER PUBLICATIONS

Wikipedia—Perci Diaconis—Stanford Professor of Mathematics—recognized as a leading authority on random distribution.
Google—blackjack average number of cards per hand—Blackjackincolor.
Google—baccarat cards per hand—Wizard of Odds.

* cited by examiner

*Primary Examiner* — Steven J Hylinski

(57) ABSTRACT

A business method wherein new software rules for playing a casino card game transform and improve the function of generic computers that are the existing technology that is currently used to facilitate electronic play of social casino card games and real money casino card games online and similarly transform and improve the function of generic computers that are the existing technology that is currently used to facilitate play of electronic table games in brick and mortar casinos wherein said generic computers use a new method to determine the effect that each dealt card has on winning and a new method to determine which hand is the winning hand wherein bets are resolved faster resulting in a significant cumulative effect wherein in a substantial number of instances a human card dealer cannot resolve bets faster by employing said new software rules.

4 Claims, 4 Drawing Sheets

BUSINESS METHOD

BACKGROUND—PRIOR ART

There is a growing trend in brick and mortar casinos to replace human card dealers with electronic table games. One important reason for said trend is that electronic table games enable casinos to save money on salaries. A second important reason for said trend is that electronic table games resolve bets faster than human dealers and thereby enable casinos to book more bets per hour.

In regard to said second important reason, electronic table games are employed not only to resolve bets faster than a human dealer, electronic table games are employed to resolve bets as fast as possible. And if electronic table games are not resolving bets as fast as possible, they are not fully accomplishing their purpose and that is a problem in terms of not maximizing benefit to the casino.

New software rules for playing a casino card game help solve this problem by enabling generic computers that are the existing technology that facilitates play of electronic table games to resolve bets faster using less memory requirement. Thereby enabling said electronic table games to better achieve their purpose of resolving bets as fast as possible.

Specifically, said new software rules both transform and improve the way generic computers function when said generic computers evaluate the effect that each dealt card has on winning and losing. Additionally, said new software rules both transform and improve the way said generic computers determine which hand is the winning hand. Additionally, said new software rules both transform and improve the way said generic computers function in regard to ties by eliminating the need for said generic computers to recognize and respond to ties.

Similarly, said new software rules both transform and improve the function of generic computers that are the existing technology that facilitates play of social casino card games and real money casino card games online.

When social casino card games and real money casino card games are played online, resolving bets faster not only benefits casinos, resolving bets faster also benefits players, wherein said players often play on mobile devices when they are taking a short break from doing something else, thereby having a limited time to play.

DETAILED DESCRIPTION

Figure 1:
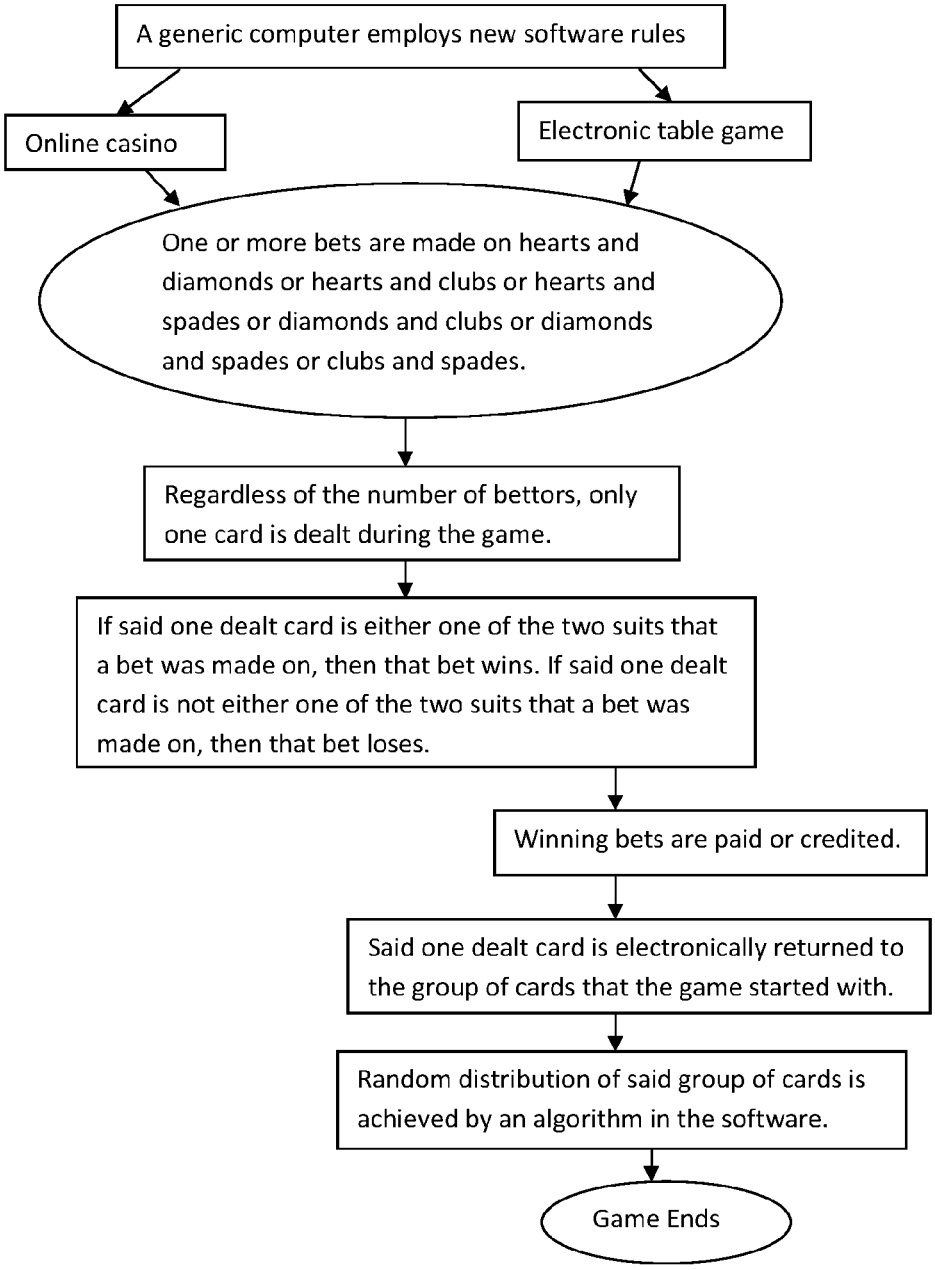
FIG. 1 Shows one example of how said new software rules can work.
Figure 2:
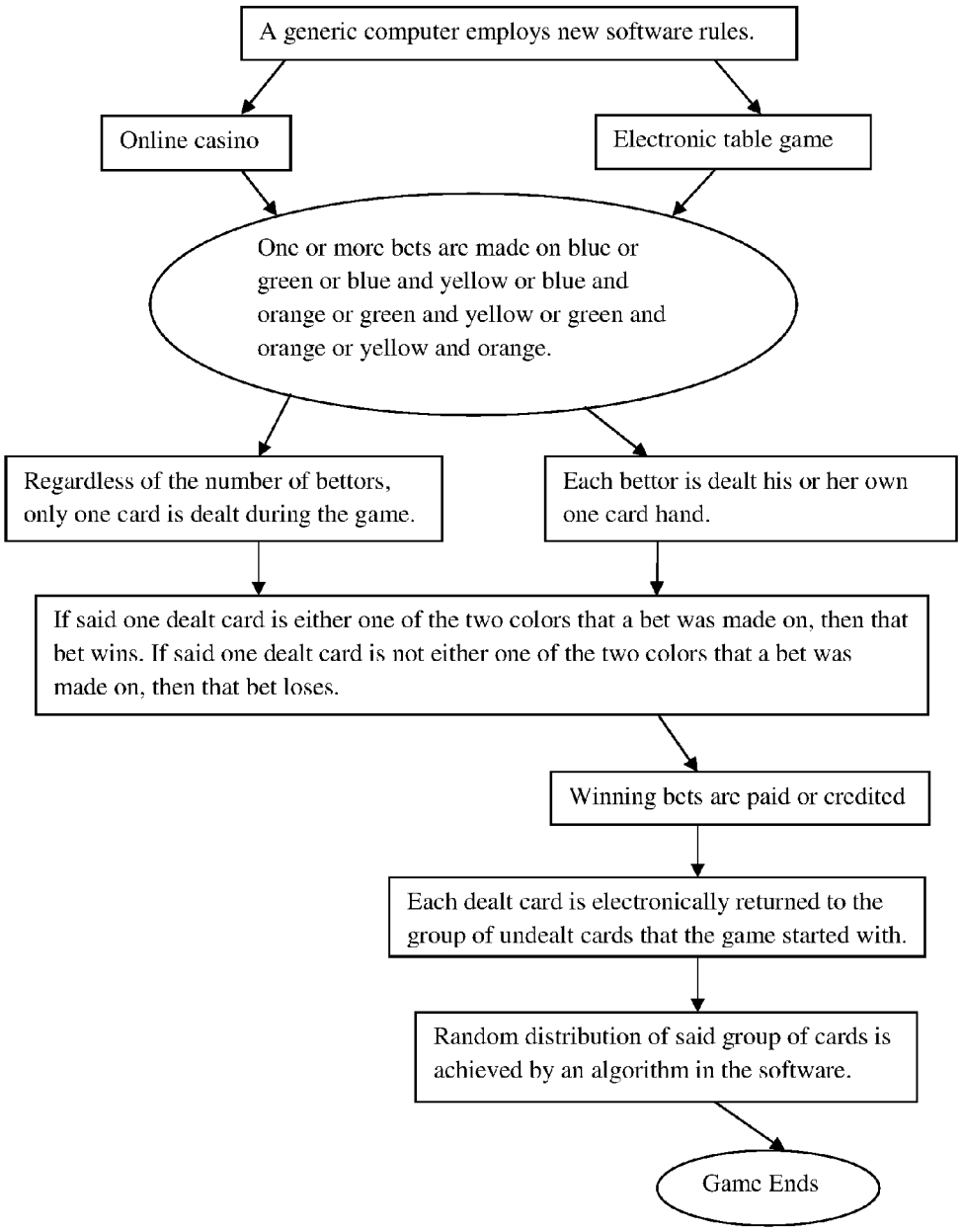
FIG. 2 Shows a second example of how said new software rules can work.
Figure 3:
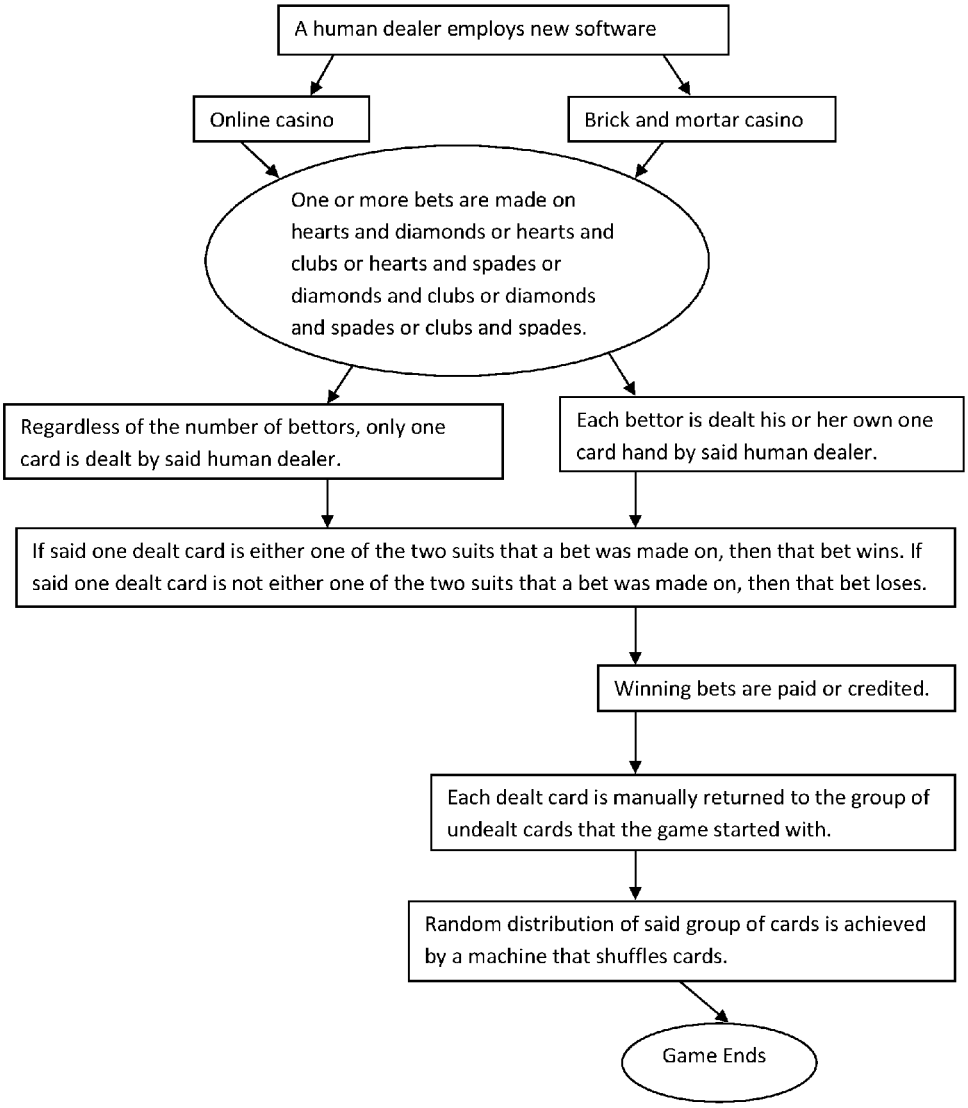
FIG. 3 Shows a third example of how said new software rules can work.
Figure 4:
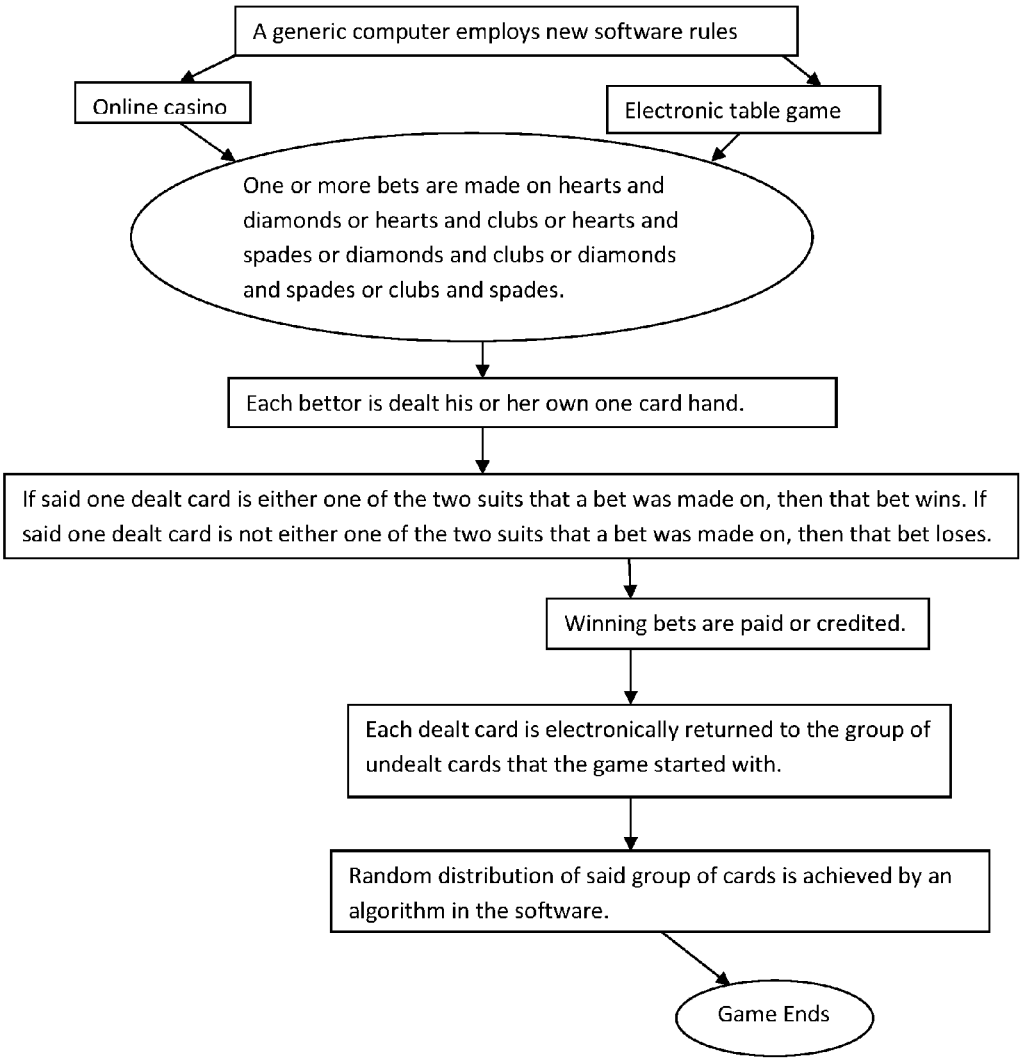
FIG. 4 Shows a fourth example of how said new software rules can work.

What will be described is a method wherein new software rules (NSRS) for playing a casino card game both transform and improve the function of generic computers of the type that are the existing technology that is currently used to facilitate electronic play of social casino card games and real money casino card games online. Similarly, said NSRS both transform and improve the function of generic computers of the type that are the existing technology that is currently used to facilitate play of electronic table games that feature cards in brick and mortar casinos.

Specifically, said NSRS transform and improve the way said generic computers function when said generic computers evaluate the effect that each dealt card has on winning and losing. Said NSRS also transform and improve the way said generic computers function when said generic computers determine which hand is the winning hand. Said NSRS also transform the way said generic computers function in regard to recognizing and responding to ties. Thereby said NSRS enable said generic computers to resolve bets faster using less memory requirement.

Said NSRS are as follows: 1 or more bets are made on hearts and diamonds or hearts and clubs or hearts and spades or diamonds and clubs or diamonds and spades or clubs and spades. Regardless of the number of bettors, 1 card is electronically dealt wherein said 1 dealt card is the only card that is dealt during the game.

If said 1 dealt card is either one of the two suits that a bet was made on, then that bet wins. If said 1 dealt card is not either one of the two suits that a bet was made on then that bet loses.

After winning and losing is decided, said 1 dealt card is returned electronically to the group of undealt cards that the game started with. Then an algorithm in said new software, almost instantaneously, randomly distributes said 1 dealt card amongst said group of undealt cards.

Returning said 1 dealt card to said starting group of cards plus said random distribution is a necessity that prevents bettors from bankrupting the casino. For example, if the game is played with one 52 card deck and the 1 dealt card is a diamond and said diamond is not returned to the deck, the deck would then consist of 12 diamonds, 13 spades, 13 clubs and 13 hearts. Thereby, by betting on any two card combination of spades, clubs and hearts, the bettor would have a 26 to 25 probability of winning which equates to a 1.96% edge for the bettor.

If a second card is dealt and not returned to the deck, regardless of the suit of the second card, bettors probability of winning in the next round of betting would be 26 to 24 which equates to a 4% edge for the bettor.

To explain, if the second card is also a diamond, bettors would have a 26 to 24 edge by betting on any two card combination of spades, clubs and hearts. If the second card is not a diamond, bettors would have the same 26 to 24 edge by betting on the two suits that were not dealt.

Whenever there is an equal number of hearts, diamonds, clubs and spades in a deck or decks and cards are dealt from said deck or decks and not returned, after the first card is dealt, it is a certainty that bettors will have an edge on the next three 1 card games. After 4 cards are dealt from a full deck and not returned, there is only an approximately 10% probability that the remaining cards will have an equal number of hearts, diamonds, clubs and spades. (The probability of 4 cards dealt from a 52 card deck being 1 heart, 1 diamond, 1 club and 1 spade is roughly 3/4 times 2/4 times 1/4 equals 6/64. The exact probability is 39/51 times 26/50 times 13/49.)

As said, even if said 10% probability happens, it is a certainty that bettors will have an edge after the next card is dealt and not returned. If the 90% probability happens, the differential between average distribution of 1 heart, 1 diamond, 1 club and 1 spade and the actual distribution of dealt cards can keep increasing, thereby increasing the bettors edge.

Regardless of the number of decks, if each dealt card is not returned to the group of cards that the game started with, card counting would be very easy for anyone of average intelligence because only 1 card is dealt during each game and all a bettor has to count is how many hearts, diamonds, clubs and spades have been dealt.

There are 4 suits, hearts, diamonds, clubs and spades. When a card is dealt from a full deck or full decks, which ever pair of suits a bet is made on, said bet has a 2 in 4 probability of winning. In other words, bettors and the casino each have the same probability of winning each bet.

There are multiple ways for a casino to take an edge on a bet that is even up. For instance, but not limited to, paying less than true odds if a bettor wins with a 2 of hearts or a 2 of diamonds or a 2 of clubs or a 2 of spades.

Also, for instance but not limited to, charging a commission on all winning bets or requiring bettors to lay odds.

Similarly optional is the size of the casino edge. For instance, but not limited to paying 1 for 2, 3 for 5, 2 for 3, 7 for 10 or 3 for 4 on a bet that is won with a card designated by any of said 2 of hearts or 2 of diamonds or 2 of clubs or 2 of spades. Also, for instance but not limited to charging a 5,4,3 or 2% commission on all winning bets or requiring bettors to lay 21 to 20, 26 to 25, 31 to 30 or 41 to 40 odds.

Because said NSRS transform and improve the function of said generic computers wherein only 1 card is dealt during each game regardless of the number of bettors and because said NSRS eliminate the possibility of ties, said generic computers that employ said NSRS can resolve bets faster than said generic computers can resolve bets when said generic computers are employing software rules for other card games wherein multiple cards and multiple hands are dealt and wherein ties result in unresolved bets.

How much faster said NSRS resolve bets varies depending on which software rules said NSRS are being compared to and how many bettors are being dealt cards by the same electronic dealer.

For instance, according to Michael Shackleford, Adjunct Professor of Actuarial Science and Mathematics at University of Nevada, Las Vegas (a.k.a. the wizard of odds), on average, each blackjack hand is 2.75 cards. Thereby, if one bettor is betting against a dealer, on average, one bet results in dealing 5.5 cards.

In contrast to dealing said 5.5 cards, said NSRS resolves each bet between 1 bettor and 1 dealer by dealing only 1 card.

In blackjack, each bettor is required to choose between hitting or standing pat. Thereby, to enable each bettor to make said decision for him or herself, each bettor is dealt his or her own hand. Thereby, if an electronic table game featuring blackjack has 5 bettors and 1 electronic dealer, on average, 16.5 cards are dealt to resolve 5 blackjack bets.

In contrast, when an electronic table game features said NSRS and there are 5 bettors and 1 electronic dealer, 5 bets can be resolved by dealing 1 card instead of 16.5 cards.

One possible variation of said NSRS is to deal each bettor his or her own 1 card hand. Thereby, if there are 5 bettors and 1 electronic dealer, 5 bets would be resolved by dealing 5 cards. Thereby, said possible variation would still resolve bets faster than bets are resolved in blackjack by dealing 5 cards instead of 16.5 cards.

Similarly, when there are 2 bettors and 1 dealer, on average, 8.25 cards are dealt in each blackjack game compared to 2 cards being dealt when said NSRS are employed wherein each bettor is dealt his or her own 1 card hand. With 3 bettors and 1 dealer, on average, 11 cards would be dealt in each blackjack game compared to 3 cards being dealt when said NSRS variation is employed. With 4 bettors and 1 dealer, the number for blackjack would be 13.75 cards and the number for said NSRS variation would be 4 cards.

Blackjack is the most popular table game in Nevada wherein blackjack represents 56% of the table games in Nevada.

Baccarat is the most profitable table game in Nevada. According to Professor Shackleford, when there is 1 bettor and 1 dealer in baccarat, on average, 4.95 cards are dealt to resolve 1 bet. Since baccarat does not require bettors to make any decisions after the game has started, each bettor is not dealt his or her own hand. Thereby, whether there is 1 bettor or 5 bettors, the same average of 4.95 cards are dealt to resolve all bets.

Said 4.95 cards are 3.95 cards more than said 1 dealt card that can resolve 1 or more bets when said NSRS are employed.

Casino war is not very popular in Nevada, producing only a tiny fraction of the gaming revenue produced by blackjack and baccarat. The reason that casino war is being discussed is for comparison purposes because casino war is the simplest of current table games, involving dealing the fewest cards.

In casino war, 1 card is dealt to each bettor and 1 card is dealt to the dealer. A bettor wins if said bettor's 1 card has a higher value than said dealers 1 card, according to poker rules for determining value. If a tie occurs, the bettor has a choice of losing half his bet or doubling his bet wherein 1 more card is then dealt to the bettor and 1 more card is dealt to the dealer. Then, if the bettor has the higher value card, the bettor only wins the amount of said bettor's original bet and if said bettor loses, said bettor loses twice the amount of his original bet.

(Said rule wherein the bettor loses half his bet on ties or is required to lay 2 to 1 on an even money bet explains why casino war isn't nearly as popular as other casino table games.)

In casino war, when there is 1 bettor and 1 dealer, 1 bet is resolved by dealing 2 cards. In contrast, with 1 bettor and 1 dealer, said NSRS resolves 1 bet by dealing 1 card.

Because casino war requires a bettor to make his or her own choice when a tie occurs, when multiple bettors are playing at the same electronic table, each bettor is dealt his or her own hand. Thereby, if there are 5 bettors and 1 dealer, 6 cards are dealt to resolve 5 bets.

In contrast, when said NSRS is employed and there are 5 bettors and 1 dealer, 1 card resolves 5 bets.

In 3 card poker, a bettor first makes an ante bet. Then, the electronic dealer deals 3 cards to said bettor and 3 cards to said dealer. Then, said bettor decides whether to fold or double said ante bet. If a bettor folds, then 1 bet is resolved by dealing 6 cards. If a bettor doubles his ante bet, then 2 bets are resolved by dealing 6 cards.

If a bettor makes 1 ante bet, in each of 3 games and folds on 1 of said 3 ante bets (in other words, if a bettor folds ⅓ of the time), then 5 bets are resolved by dealing 18 cards. (Each ante bet results in 6 cards being dealt, for a total of 18 cards. Then said ante is doubled 2 out of 3 times resulting in a total of 5 bets.)

In contrast, when there is 1 bettor and 1 dealer and said NSRS is employed, 5 bets would be resolved by dealing 5 cards instead of dealing 18 cards. (1 bettor making 1 bet in each of five 1 card games.)

If a bettor never ever folded and always doubled his or her ante bet, then 6 bets would be resolved by dealing 18 cards in 3 games. And in this extreme exaggeration of probability, said NSRS would still resolve bets much faster by resolving 6 bets by dealing 6 cards instead of 18.

Because 3 card poker requires a bettor to make his or her own choice in regard to folding or doubling the ante bet, when multiple bettors are playing on the same electronic table game, each bettor is dealt his or her own hand.

In 3 card poker, if there are 5 bettors and 1 dealer, 18 cards are dealt. (3 cards to each bettor and 3 cards to the dealer) If 4 out of 5 bettors double their ante, a total of 9 bets are made. Thereby each bet is resolved by dealing 2 cards. And thereby, on average, 5 bets are resolved by dealing 10 cards.

In contrast when said NSRS is employed and there are 5 bettors, 5 bets are resolved by dealing 1 card instead of 10 cards.

All the various poker variations require bettors to make 1 or more choices after the game starts. Thereby all the poker variations require each bettor to be dealt his or her own hand wherein each hand is comprised of multiple cards. Thereby, said NSRS always involves dealing fewer cards when there is 1 bettor and even bigger differential of fewer cards when there are multiple bettors.

Said differentials in cards that are dealt between said NSRS and blackjack, casino war, three card poker and other casino banked poker variations are the same when said NSRS are employed in an electronic table game and when said NSRS are employed in an online casino.

Online casinos and brick and mortar casinos are open 24 hours a day, 365 days a year. Thereby, said NSRS ability to enable generic computers to resolve bets faster can have a significant cumulative effect.

For example, people living in different time zones around the world can have access to online casinos. Thereby online casinos can be busy 24 hours a day. If said NSRS is being employed on one generic computer in one online casino and said generic computer is only able to resolve one more bet per hour relative to other casino games, the cumulative effect would be one generic computer resolving 8,760 more bets per year.

One more bet per hour is a conservative example. As said, how much faster said NSRS resolves bets depends on which game rules said NSRS are being compared to and how many bettors are betting. Regardless, said cumulative effect can be very significant especially when said NSRS is compared to blackjack which is, by far, the most prevalent casino game.

Blackjack, baccarat, casino war a three card poker all feature optional side bets. Said NSRS also enables additional bets. For instance, but not limited to, one bettor being able to bet on up to three pairs of suits.

For example, if a bettor bet on hearts and diamonds and also made an additional bet on hearts and clubs and also made an additional bet on hearts and spades, if the 1 dealt card is a heart, said bettor would win three bets. If said 1 dealt card was a diamond, a club or a spade, said bettor would win one bet and lose two bets. Thereby, when there is one bettor, 1 dealt card can resolve three bets.

In regard to said NSRS enabling generic computers to resolve bets faster with less memory requirement, blackjack is usually played online and on electronic table games with six or eight decks. The reason for using six or eight decks is not concern about card counting because software usually returns the dealt cards to said six or eight decks and then randomizes said six or eight decks after each round of bets is resolved (after each blackjack game). The reason that blackjack is usually played electronically with six or eight decks is that using said six or eight decks gives the casino a bigger edge than using one deck.

When blackjack is played with one 52 card deck, it is more likely that a bettor will be dealt a blackjack (an ace plus a ten, jack, queen or king). The math is as follows: if the first card dealt to a bettor from a 52 card deck is a ten, jack, queen or king, the probability of the second card, dealt to said bettor, being an ace is 4 out of 51. If the first card dealt to a bettor from eight 52 card decks is a ten, jack, queen or king, the probability of the second card dealt to said bettor being an ace is 32 out of 415, which is a lower probability than 4 out of 51.

The number of blackjacks matters because blackjack usually pays 3 for 2 to the bettor. Thereby, the fewer the number of blackjacks, the bigger the casino edge.

Similarly, the casino has a bigger edge when casino war is played with six or eight decks because, as said, the casino takes its edge in casino war and on ties and ties are more likely when casino war is played with six or eight decks instead of fewer decks.

Similarly, the casino edge also increases when baccarat is played with six or eight decks.

In regard to blackjack, baccarat and casino war, each additional deck slightly increases the casino edge. Thereby, playing said games with fewer decks disadvantages the casino relative to playing said games using more decks.

In contrast, when said NSRS are employed on generic computers, the casino is not disadvantaged by using one or two 52 card decks instead of six or eight 52 card decks. The reason is that, when said NSRS are employed, the probability of the casino winning remains the same regardless of how many decks a card is dealt from. Specifically, the bettor has the same probability of winning each bet as the casino regardless of the number of full decks that a card is dealt from.

Because the casino is not disadvantaged by using fewer decks when employing said NSRS, said NSRS makes it practical to employ fewer decks. Thereby, enabling said generic computers to reduce their memory requirement by eliminating the need to keep track of hundreds of additional cards.

An important reason why said NSRS enables said generic computers to resolve bets faster while using less memory requirement, is that said NSRS transform and improve the way said generic computers function in three ways.

First, said NSRS transform the way said generic computers evaluate the effect that each dealt card has on winning and losing by eliminating the need for said generic computers to be aware of thirteen different card values ranging from two through ace.

Blackjack, baccarat, casino war, three card poker and the other poker variations all require said generic computers to be aware of said thirteen different card values.

In contrast, said NSRS requires said generic computers to only be aware of four different cards values, hearts, diamonds, clubs and spades, wherein, all said four suits have the same value. Thereby eliminating the need for said generic computers to recognize, for instance, that a 10 of hearts has a higher value than a 3 of hearts. According to said NSRS, a heart is a heart regardless of which number or royalty accompanies said heart on a card.

Second, said NSRS transforms the way said generic computers function, when said generic computers determine winning and losing, by eliminating the need for said generic computers to determine the value of the dealers hand and determine the value of the bettors hand and then compare said two values to determine which hand is the winning hand.

The software rules for blackjack, baccarat, casino war, three card poker and the various casino banked poker variations all require that said generic computers must determine the value of the players hand and the dealers hand and then compare said two values to determine winning and losing.

In contrast, as said, said NSRS determine winning and losing in a totally different way that is also a much simpler way.

Third, blackjack, baccarat, casino war, three card poker and other poker variations all have ties.

In contrast, said NSRS makes ties impossible. Thereby, further transforming the function of said generic computers by eliminating the need for said generic computers to be aware of ties and thereby eliminating the need for said generic computers to respond appropriately to a tie in regard to whether a tie is a penalty free do-over or a loss for the bettor.

If said NSRS is employed wherein there is a lower pay off when a bettor wins with 2, then a generic computer would have to be aware of said one number (the number 2) in regard to the amount of said pay off. However, said generic computer would not have to be aware of the number 2 in regard to the effect that each dealt card has on winning and losing or be aware of the number 2 in regard to which hand is the winning hand or be aware of the number 2 in regard to a tie.

Said NSRS, wherein only 1 card is dealt during each game, always enables generic computers of the type that facilitate online play and play on electronic table games to resolve bets faster than said generic computers can resolve bets when said generic computers run software for blackjack, baccarat, casino war and three card poker.

In contrast, if a human card dealer tried to implement said NSRS wherein only 1 card is dealt during each game, in a substantial number of instances, said human card dealer would not be able to resolve bets faster than said human card dealer can resolve bets when said human card dealer deals cards for blackjack, baccarat, casino war and three card poker. In fact, in a substantial number of instances, a human card dealer would resolve bets more slowly.

As said, in baccarat, regardless of the number of bettors, on average, 4.95 cards are dealt to resolve 1 or more bets in one game. In contrast, said NSRS can resolve 1 or more bets after only 1 card is dealt in one game. Thereby said human dealer, dealing 1 card, instead of 4.95 cards, would resolve bets faster except for the fact that said NSRS requires that said 1 dealt card must be returned to the group of cards that the game started with and then said group must be randomized wherein said 1 dealt card has the same probability of being the next dealt card, in the next game, as every other card in the group of cards that the game started with.

As said, if 1 dealt card is not returned to a 52 card deck, bettors would have a 1.96% edge when the next 1 card game starts. Similarly, if bettors knew that said 1 dealt card was returned to the deck and said deck was not shuffled in a way that sufficiently randomized said deck, bettors would gain the same 1.96% edge by realizing that said 1 dealt card is not going to be the top card in the deck and thereby said 1 dealt card is not going to be the 1 dealt card in the next 1 card game.

Said 1.96% edge for bettors would grow to a 100% bettors edge if cards were not properly randomized and thereby bettors could observe that the 1 dealt card was on the top of the deck and thereby would be the 1 dealt card in the new 1 card game.

Perci Diaconis is a Professor of Mathematics and Statistics at Stanford University. Professor Diaconis is considered to be a leading authority on the subject of random distribution. In 1992 professor Diaconis published a paper saying that a 52 card deck must be riffle shuffled at least 7 times to achieve acceptable random distribution of the cards in a 52 card deck.

Each said riffle shuffle is a 3 step process. First, a dealer must divide a 52 card deck into to 2 separate 26 card piles by feel. Second, said dealer must shuffle the front corners of said 2 piles wherein said 2 piles then come partially together. Third, said dealer must push said 2 piles toward each other until said 2 piles are totally together. In total, doing seven riffle shuffles is a 21 step process. Thereby, dealing only 1 card results in a human dealer dealing 3.95 fewer cards than said human dealer would deal when dealing 1 game of baccarat, and then having to go through a 21 step process of doing 7 riffle shuffles before the next card can be dealt in a new 1 card game.

Thereby, in regard to baccarat, a human card dealer cannot resolve bets faster by employing said NSRS wherein only 1 card is dealt during each game. In fact, the opposite is true. Said human card dealer would be resolving bets more slowly not faster.

Unlike said NSRS wherein there is a need to randomize the full deck after each 1 card game, there is not a similar need to randomize the decks in baccarat after each 4.95 card game. Unlike the situation with said NSRS, bettors will not have an edge if the deck or decks are not randomized after each baccarat game wherein 4.95 cards are dealt.

Usually, when a human dealer deals baccarat in a casino, six or eight decks are used and said six or eight decks are not shuffled until half the cards in said six or eight decks have been dealt. This equates to dealing, on average, 156 cards before said six decks are recombined and shuffled. This equates to dealing 31 games wherein, on average, 4.95 cards are dealt in each game before cards are recombined and shuffled.

After 156 cards are dealt in said 31 games, a human dealer would riffle shuffle each of said six decks 7 times, involving 21 steps for each deck, for a total of 126 steps. In contrast, 31 games of said NSRS wherein 1 deck is riffle shuffled 7 times after each game would result in 651 steps (21 steps for riffle shuffling after each game times 31 games).

If you consider each dealt card as 1 step, the number of steps in 31 games of baccarat would be 282 (126 for riffle shuffling plus 156 for dealing 156 cards). In contrast, the number of steps in 31 one card games of said NSRS would be 682 (21 steps for riffle shuffling after each game times 31 games plus 31 steps for dealing 31 cards).

The differential in number of steps is even greater in eight deck baccarat.

When baccarat is played electronically online or on an electronic table game, decks can be randomized after each 4.95 card game because said randomization is done almost instantaneously when it is done electronically and thereby said randomization doesn't slow down the game the way a human dealer would slow it down if said human dealer shuffles six or eight decks after each 4.95 card game.

According to University of Nevada Las Vegas Research, there were 1,362 blackjack tables in Las Vegas in 2015. Wherein said blackjack tables represented approximately 51% of the gaming tables in Las Vegas. According to Blackjack Survey, which lists the number of blackjack tables in each casino in Las Vegas, approximately 73% of the blackjack tables in Las Vegas feature six or eight deck blackjack, approximately 20% featured two deck blackjack and approximately 7% feature one deck blackjack.

Usually when six or eight deck blackjack is played, approximately half the cards are dealt before said dealt cards are recombined with the undealt cards and shuffled.

Unlike said NSRS, when six or eight deck blackjack is played, bettors will not gain an edge if cards are not shuffled and appropriately randomized after each game. Clearly, experience has shown casinos that shuffling after half the cards have been dealt is enough shuffling to protect against bettors gaining an edge from card counting. Thereby, casinos don't want to slow play down more than necessary by shuffling more than necessary.

When eight deck blackjack is dealt by a human dealer, cards are usually shuffled after approximately 208 cards have been dealt. When there is one bettor and one dealer, on average, 5.5 cards are dealt during each blackjack game (2.75 cards to the dealer and 2.75 cards to the bettor, on average). Thereby a total of 37 games will be played before all eight decks are recombined and shuffled. (5.5 cards dealt in each game times 37 games equals 203.5 cards dealt before cards are recombined and shuffled.) Riffle shuffling each of eight decks involves a total of 168 steps (8×21). If you equate each dealt card with one step, the result is 203.5 steps. Thereby, the total number of steps from riffle shuffling and card dealing is 371.5 steps (168+203.5).

In contrast when said NSRS is employed and there is one human dealer using one 52 card deck while dealing to one bettor, 37 one bet, 1 card games would result in 37 riffle shuffles which would result in 761 steps (37×21). If you add the 37 steps of dealing 37 one card games, employing said NSRS would result in a total of 798 steps. Clearly, resolving said 37 NSRS bets would be slower than resolving said 37 blackjack bets because employing said NSRS results in over 400 additional steps to achieve the same result of resolving 37 bets.

As said, said NSRS can be employed using one 52 card deck without disadvantaging the casino. However, said NSRS does not specify the use of only one deck. Thereby, a truer comparison of a human dealer dealing blackjack and a human dealer employing said NSRS would be comparing a human dealer dealing eight deck blackjack and a human dealer employing said NSRS using eight decks when each are dealing to one bettor.

If said eight decks are riffle shuffled after each NSRS 1 card game, that would result in a human dealer having to engage in a 6,216 step process (168×37).

When multiple bettors are playing blackjack at the same table, the number of cards that are dealt in each game increases and thereby the number of games that are played before cards are shuffled decreases. In other words, the larger the number of bettors, the fewer the number of games that will be played before cards are shuffled.

For instance, if two bettors are playing eight deck blackjack, on average, 8.25 cards will be dealt during each game. (2.75 cards to each bettor plus 2.75 cards to the dealer) Thereby, on average, cards would be shuffled after 25 games, 12 less games than when there is only one bettor.

During said 25 games, a blackjack dealer would, on average, deal 206.25 cards (25×8.25) and then riffle shuffle eight decks for a total of 374.25 steps (168+206.25).

If two bettors are playing at a table wherein said NSRS are being employed and one deck is also being employed, a human dealer would deal 25 one card games and after each of said 25 games, said human dealer would riffle shuffle the deck 7 times for a total of 550 steps (25×21+25).

Thereby, with two bettors, employing said NSRS results in substantially more steps, which results in said NSRS resolving the same number of bets, 50 bets, more slowly than said 50 bets can be resolved when said human dealer deals blackjack.

If three bettors are playing eight deck blackjack at the same table, on average, 11 cards are dealt during each game. Thereby, on average, 19 games will be played before cards are shuffled. This results in 377 steps (209-168).

If three bettors are playing at a table wherein said NSRS is being employed and one deck is also being employed, 19 games would result in 418 steps (19×21+19).

Again, three bettors results in more steps which results in said NSRS resolving the same number of bets more slowly than bets are resolved in blackjack.

When eight deck blackjack is played with four bettors at the same table and said NSRS is employed at a table with four bettors, said NSRS results in less steps and would thereby resolve bets faster, not slower, than the same number of bets would be resolved in blackjack.

Similarly, if there are five bettors and said NSRS is played with one deck, said NSRS would resolve the same number of bets faster.

However, with said 5 bettors, if a truer comparison is made wherein blackjack is played with eight decks and said NSRS is employed with eight decks, employing said NSRS would result in substantially more steps and would thereby resolve the same number of bets substantially slower.

On average, 16.5 cards will be dealt during each game when five bettors and one dealer are playing blackjack (2.75×6=16.5). Thereby, when eight deck blackjack is played by five bettors, on average, twelve games will be played before cards are shuffled. Thereby, on average, 198 cards will be dealt before said dealt cards are recombined with the undealt cards and then each of said eight decks is riffle shuffled seven times for a total of 366 steps (198+168=366).

If five bettors are playing at the same table wherein said NSRS is being employed and said eight decks are also being employed and said eight decks are riffle shuffled after each 1 card game, twelve games would result in 2,016 steps.

Additionally, a human dealer can employ said NSRS using substantially fewer than eight decks and still resolve bets more slowly than said human dealer can resolve bets when dealing eight deck blackjack to five bettors.

For instance, when said NSRS is employed using two decks, a human dealer would have to appropriately shuffle each of said two decks after each of twelve games which results in 504 steps (21×2×12). Add twelve steps for dealing twelve 1 card games and the total is 516 steps which is substantially more than the 366 steps resulting from a human dealer dealing eight deck blackjack to five bettors.

When six deck blackjack is dealt by a human dealer, cards are usually shuffled after approximately half the cards in said six decks have been dealt. In other words, cards are usually shuffled after approximately 156 cards have been dealt.

When there is one bettor and one dealer, on average, 5.5 cards are dealt during each blackjack game. Thereby, on average, twenty eight games (28×5.5=154) would be played before said six decks are recombined and shuffled.

Riffle shuffling each of said six decks seven times results in 126 steps (21×6=126). Dealing 154 cards adds 154 steps to said 126 steps for a total of 280 steps needed to resolve twenty eight bets (one bet in each game).

When there is one bettor and a human dealer is employing said NSRS and also employing one 52 card deck, seven riffle shuffles after each 1 card game would result in 588 steps (28×21=588). Said 588 steps added to 28 steps for dealing 28 cards adds up to a total of 616 steps to resolve twenty eight bets.

Clearly, resolving the same number of bets with more steps results in bets being resolved more slowly.

When there are two bettors and one dealer dealing six deck blackjack, on average, 8.25 cards are dealt in each game. Thereby, on average, eighteen games will be played before a human dealer will riffle shuffle each of said six decks seven times, resulting in a total of 274.50 steps (126 steps for riffle shuffling plus 148.50 steps for cards dealt).

When there are two bettors and one human dealer employing said NSRS and also employing one 52 card deck, seven riffle shuffles after each of eighteen 1 card games would result in 378 steps (21×18). Said 378 steps added to eighteen steps for dealing eighteen cards adds up to 396 steps.

When there are three bettors and one dealer dealing blackjack, on average, eleven cards are dealt in each game. Thereby, on average, fourteen games are dealt before a human dealer will recombine and riffle shuffle each of said six decks. Said dealing and shuffling, on average, results in 280 steps (126 steps for shuffling and 154 steps for cards dealt).

When there are three bettors and one human dealer employing said NSRS and also employing one 52 card deck, appropriately shuffling said one deck after each of fourteen 1 card games results in 294 steps (21×14). Said 294 steps plus fourteen steps for dealing fourteen cards equals 308 steps.

When there are four or five bettors playing six deck blackjack, a human dealer can resolve bets faster when employing said NSRS and employing one 52 card deck and dealing to four or five bettors.

However, a truer comparison wherein six deck blackjack dealt by a human dealer is compared to said NSRS being played with six decks and dealt by a human dealer shows that dealing said NSRS involves substantially more steps and thereby resolves the same amount of bets substantially slower, not faster than blackjack.

For instance, when there are five bettors and one dealer, on average, 16.5 cards are dealt in each blackjack game (2.75×6). Thereby, on average, nine games would be played before a human dealer recombined and appropriately shuffled said six decks, resulting in a total of 274.5 steps of dealing and shuffling (148.5+126).

If a human dealer employed said NSRS and also employed six decks, appropriately shuffling each of said six decks after each of nine 1 card games would result in 1,134 steps (126×9).

When said NSRS is employed using substantially fewer than six decks, a human dealer dealing to five bettors would resolve bets more slowly than a human dealer dealing six deck blackjack to five bettors.

As said, five bettors playing six deck blackjack results, on average, in cards being shuffled after nine games, resulting in a total of 274.5 steps for shuffling and dealing.

When a human dealer employing said NSRS deals to five bettors using two decks, said human dealer will appropriately shuffle each of said two decks nine times for a total of 378 steps (21×2×9). Add nine steps for dealing nine 1 card games and the total is 387 steps.

When two deck blackjack is dealt by a human dealer, cards are usually shuffled after approximately half the cards are dealt which equates to dealing approximately 52 cards before cards are shuffled.

When one bettor is being dealt two deck blackjack, on average, nine 5.5 card games will be dealt before a human dealer appropriately shuffles said two decks resulting in 42 steps for shuffling plus 49.5 steps for dealt cards which equals a total, on average, of 91.5 steps.

When said NSRS is employed by a human dealer employing one deck and dealing to one bettor, said human dealer would appropriately shuffle said one deck after each of nine 1 card games resulting in 189 steps. Add nine additional steps for dealing nine cards and the total is 198 steps.

When two bettors are playing two deck blackjack, on average, 8.25 cards will be dealt in each game resulting in a human dealer, on average, shuffling said two decks after six 8.25 card games, resulting in 49.5 cards being dealt (8.25×6). Add 42 steps for appropriately shuffling said two decks and the total number of steps is 91.5 steps.

When said NSRS is employed by a human dealer who is employing one deck while dealing to two bettors, said human dealer would appropriately shuffle said one deck after each of six 1 card games resulting in 126 steps plus six additional steps for dealing six 1 card games.

When three bettors are playing two deck blackjack, on average, eleven cards will be dealt in each game, resulting in a human dealer appropriately shuffling said two decks, on average, after four eleven card games wherein a total of forty four cards are dealt. Add 42 steps for appropriately shuffling and the total is 86 steps.

When said NSRS is employed by a human dealer who is employing one deck while dealing to three bettors, said human dealer would appropriately shuffle said one deck after each of four 1 card games, resulting in 84 steps plus four additional steps for dealing said four 1 card games, for a total of 88 steps.

When two deck blackjack is played by four or five bettors and said NSRS employs one deck, said NSRS involves fewer steps and thereby a human dealer would resolve bets faster when employing said NSRS.

However, when a truer comparison is made between a human dealer dealing two deck blackjack and a human dealer employing said NSRS using two decks, positions are reversed and said two deck NSRS involved more steps to resolve the same number of bets and thereby said NSRS resolves bets more slowly.

For example, when five bettors are playing two deck blackjack, on average, 16.5 cards (2.75×6) are dealt during each game. Thereby a human dealer would shuffle cards after three games which would, on average, result in total of 49.5 cards being dealt. Add 42 steps for appropriately shuffling said two decks and the total is 91.5 steps.

When a human dealer employs said NSRS and also employs two decks when dealing to five bettors, said human dealer would shuffle each of said two decks after each of three 1 card games, resulting in 126 steps (2×21×3) plus three steps for dealing three 1 card games, for a total of 129 steps.

When one deck blackjack is dealt by a human dealer, cards are usually shuffled after approximately half the deck has been dealt, which equates to shuffling after approximately twenty six cards have been dealt.

When there is one bettor and one dealer, on average, 5.5 cards are dealt in each blackjack game. Thereby, on average, four games would be played before a human dealer appropriately shuffled the one deck that the game is played with.

Appropriately shuffling said one deck plus dealing twenty two cards (5.5×4) results in 43 steps to resolve four bets.

When there is one bettor and a human dealer is employing said NSRS and also employing one deck of cards, appropriately shuffling said one deck after each of four 1 card games would result in 84 steps. Add four steps for dealing four cards and the total is 88 steps to resolve four bets.

When one deck blackjack is played by two bettors and one dealer, on average, three 8.25 card games would be played before a human dealer appropriately shuffled said one deck, resulting in, on average, a total of 45.75 steps (21 steps for riffle shuffling one deck plus 24.75 steps for dealing 24.75 cards).

When there are two bettors and a human dealer wherein said human dealer is employing said NSRS and also employing one deck of cards, appropriately shuffling said one deck after each of three 1 card games would result in 63 steps. Add three steps for dealing three cards and the total is 66 steps.

When one deck blackjack is played by three bettors and one dealer, on average, two eleven card games would be played before a human dealer appropriately shuffled said one deck resulting in a total of 43 steps (21 steps for riffle shuffling plus 22 steps for dealing 22 cards).

When there are three bettors and a human dealer is employing said NSRS while employing one deck of cards, appropriately shuffling said one deck after each of two 1 card games would result in 42 steps. Add two steps for dealing two cards and the total is 44 steps.

When one deck blackjack is played by four or five bettors, a human dealer employing said NSRS and also employing one deck would resolve bets with less steps and would thereby resolve bets faster.

In 2015, baccarat (311 tables) and blackjack (1,362 tables) represented approximately 63% of the table games in Las Vegas and over 75% of the table games in Las Vegas played with cards. (Roulette, 254 tables, and craps, 187 tables are not played with cards.)

Regardless of the number of bettors, when baccarat is dealt by a human dealer and said NSRS are dealt by a human dealer, said NSRS always involves more steps to resolve the same number of bets and thereby always resolves bets more slowly.

When one bettor or two bettors or three bettors are playing eight deck, six deck, two deck or one deck blackjack dealt by a human dealer, and said NSRS are being employed by a human dealer who is dealing from one deck of cards, employing said NSRS always involves more steps to resolve the same number of bets and thereby always resolves bets more slowly.

Thereby, in a substantial number of instances, when said NSRS is employed by a human dealer who is employing one deck, the result will be that said human dealer will resolve bets more slowly than said human dealer can resolve bets when dealing baccarat or blackjack.

When four or five bettors are playing eight deck, six deck, two deck or one deck blackjack dealt by a human dealer and said NSRS is being employed by a human dealer who is dealing from two or more decks, said NSRS always involves more steps to resolve the same number of bets and thereby always resolves bets more slowly.

In contrast, when computer generated electronic play of baccarat and blackjack is compared to computer generate electronic play of said NSRS, said NSRS always involves less steps to resolve the same number of bets and thereby always resolves bets faster.

When six or eight deck casino war is dealt by a human dealer to one to five bettors, if said human dealer shuffled after half of the cards in said six or eight decks are dealt, a human dealer would always resolve the same amount of bets more slowly when said human dealer employed said NSRS and one or more decks.

However, human dealers do not shuffle six or eight decks when dealing casino war after half the cards in said six or eight cards have been dealt. In casino war human dealers do not hand shuffle cards. Instead, said human dealers employ a machine that shuffles cards wherein after each game said human dealers return the dealt cards to said machine which then randomizes said six or eight decks.

If human dealers employed said NSRS and also employed a machine that shuffles cards and if said human dealers returned the one dealt card to said machine after each game, said human dealers would then be able to resolve bets faster than said human dealers can resolve bets when dealing casino war and employing said machine because resolving bets by dealing only one card is faster than resolving bets by dealing multiple cards. (Casino war played by one to five bettors and a dealer results in two to six cards being dealt.)

Similarly, human dealers dealing three card poker also use a machine that shuffles and randomizes cards after each game. Also similarly, a human dealer employing said NSRS and said machine will resolve the same number of bets faster because resolving bets by dealing only one card is faster than resolving bets by dealing multiple cards.

Also similarly, if human blackjack dealers and human baccarat dealers employed a machine that shuffled cards after each game and human dealers employed said NSRS and also employed said machine that shuffles all the cards after each 1 card game, the human dealers employing said NSRS would always resolve the same number of bets faster because resolving bets by dealing one card is faster than resolving bets by dealing multiple cards.

Thereby, one possible variation of said NSRS is one or more human dealers employing one or more machines to shuffle one or more decks.

Another reason for pairing a human dealer with said machine when said dealer is employing said NSRS is to reduce the possibility of said human dealer cheating the casino.

The potential problem is that a human dealer, with some expertise, could shuffle a deck of cards wherein the next card to be dealt would be the suit of said human dealers choice. If said human dealer worked with a confederate, cards could be dealt wherein said confederate was guaranteed to win more bets than said confederate lost. The additional problem is that this form of cheating would not be immediately noticeable because it is normal for bettors to have short term winning streaks.

Baccarat, blackjack, casino war and poker are all played with standard cards. Said games could not be played with cards that are not differentiated by numbers and royalty.

In contrast, said NSRS can be implemented with equal effectiveness if non-standard cards are employed instead of standard cards. Wherein each non-standard card is designated by one of four different colors or designated by one of four different geometric shapes or designated by one of four different anything other than hearts, diamonds, clubs and spades.

For instance, but not limited to, employing a 52 card deck comprised of thirteen blue cards, thirteen green cards, thirteen yellow cards and thirteen orange cards. Bettors could then have a choice of betting on blue and green or blue and yellow or blue and orange or green and yellow or green and orange or yellow and orange. Again, in the same way as when standard cards are employed, winning and losing would be resolved by dealing only one card in each game. And again, a generic computer would resolve bets faster than said generic computer could otherwise resolve bets when running software for blackjack, baccarat, casino war and poker variations. And again the function of generic computers running said NSRS would be transformed and improved in regard to the effect that each dealt card has on winning and losing and deciding which hand is the winning hand and recognizing and responding to ties.

Regardless of whether standard or non-standard cards are used, employment of said NSRS is facilitated by one or more of a display screen, a number generator, a processor and a machine that shuffles cards.

While said NSRS have been described with respect to various embodiments thereof, it will be understood by those of ordinary skill in the art that other variations and modifications can be effected within the scope of these NSRS.

I claim:

1. A method for providing a computerized card wagering game that includes transforming and improving the function of generic computers of the type that are the existing technology that is currently used to facilitate electronic play of social casino card games and real money casino card games played online and similarly both transform and improve the function of generic computers of the type that are the existing technology that is currently used to facilitate play of electronic table games in brick and mortar casinos comprising:

employing software rules wherein bets are offered to one or more bettors on a combination of at least two card suits selected from four possible card suits, wherein after one or more bets are made by said one or more bettors, at least one card and up to a maximum number of cards is dealt to said one or more bettors from at least one deck, wherein said maximum number of cards dealt in one game equals the quantity of bettors playing said game, wherein if said one dealt card is either one of the two suits that a bet was made on then that bet wins, wherein if said one dealt card is not either one of the two suits that a bet was made on then that bet loses, wherein after winning and losing has been decided said one or more dealt cards are returned to the group of cards that the game started with, thereby said software rules enable said generic computers to resolve bets faster than said generic computers can resolve bets when said generic computers run software for blackjack, baccarat, casino war, and casino banked poker variations because said software rules result in bets being resolved by dealing one card instead of multiple cards and because said software rules eliminate the possibility of ties wherein bets are made and cards are dealt without said bets being resolved and because said software rules can result in one card deciding winning and losing for multiple bettors without each bettor being dealt his or her own hand and because said software rules both simplify and transform the steps that said generic computers must follow when said generic computers resolve bets, wherein said software rules both transform and improve the way said generic computers evaluate the effect that each dealt card has on winning and losing by eliminating the need for said generic computers to be aware of thirteen different card values ranging from 2 through ace that said generic computers must be aware of when said generic computers are running software for blackjack baccarat casino war and casino banked poker variations, wherein instead of being aware of said thirteen different card values said software rules only require that said generic computers be aware of four different card suits, wherein said software rules both transform and improve the way said generic computers determine winning and losing by eliminating the need for said generic computers to determine the value of the dealers hand and also determine the value of each bettors hand and then compare the value of each bettors hand with the value of the dealers hand to determine winning and losing which said generic computers must do when said generic computers determine winning and losing in blackjack baccarat casino war and casino banked poker variations, wherein said software rules both transform and improve the way said generic computers function in regard to ties by eliminating ties and thereby eliminating the need for said generic computers to recognize and respond to ties which said generic computers must do when said generic computers run software for blackjack baccarat casino war and casino banked poker variations.

2. The method of claim 1, wherein employment of said software rules is facilitated by one or more of a display screen, a number generator, a processor and human dealer operating a machine that shuffles cards.

3. The method of claim 1, wherein said four possible card suits comprise at least one of hearts, diamonds, clubs and spades, and four different colors, and four different geometric shapes.

4. The method of claim 1, wherein said at least one deck of cards is shuffled by a card shuffling machine operated by a human dealer prior to each game.

* * * * *